United States Patent [19]

Kaiser

[11] 4,222,362

[45] Sep. 16, 1980

[54] SPEED CONTROL FOR A ROTARY DRESSING WHEEL

[75] Inventor: Russell E. Kaiser, Mercesburg, Pa.

[73] Assignee: Litton Industrial Products, Inc., Waynesboro, Pa.

[21] Appl. No.: 26,299

[22] Filed: Apr. 2, 1979

[51] Int. Cl.[3] ..... B24B 51/14

[52] U.S. Cl. ..... 125/11 CD; 51/134.5 R; 51/165.87

[58] Field of Search ..... 51/165.87, 165.88, 134.5 R; 125/11 B, 11 CD

[56] References Cited

U.S. PATENT DOCUMENTS

| | | | |
|---|---|---|---|
| 2,601,290 | 6/1952 | Hopkins | 125/11 CD |
| 3,006,332 | 10/1961 | Cooper | 125/11 CD |
| 3,971,358 | 7/1976 | Sawluk | 125/11 CD |

*Primary Examiner*—Harold D. Whitehead

*Attorney, Agent, or Firm*—Brian L. Ribando

[57] ABSTRACT

The rpm of a rotary dresser wheel is maintained in a fixed ratio to the rpm of a grinding wheel. The rpm of the grinding wheel is increased to maintain the surface speed of the grinding wheel constant as the grinding wheel wears due to use.

2 Claims, 2 Drawing Figures

SPEED CONTROL FOR A ROTARY DRESSING WHEEL

BACKGROUND OF THE INVENTION

This invention relates to a speed control mechanism for a rotary dressing wheel which is used on a grinding machine.

U.S. Patent to Stevens, U.S. Pat. No. 3,763,844, recognizes that the speed of traverse of a nonrotating dressing tool along the face of a grinding wheel may be controlled in accordance with wheel diameter. In this patent, as the grinding wheel wears, the rpm of the grinding wheel is increased to maintain constant wheel surface speed. This allows the nonrotating dressing tool to traverse the surface of the grinding wheel in a shorter period of time since the time for one revolution of the grinding wheel at the surface is decreased. A rotary dresser wheel presents a different problem, however. As the cylindrical grinding wheel of a grinding machine becomes worn, its decreasing diameter causes the surface speed of the grinding wheel to decrease. Because this surface speed must be maintained at a certain desired speed, the rpm of the grinding wheel is increased. If the rpm of a dressing wheel is maintained constant, undesirable grinding of a workpiece results as the ratio of the rpm of the grinding wheel to the rpm of the dresser wheel changes.

SUMMARY AND OBJECTS OF THE INVENTION

The rpm of a rotary dresser wheel is maintained in a fixed ratio to the rpm of a grinding wheel. As the grinding wheel becomes worn, the rpm of the grinding wheel is increased to maintain the surface speed of the grinding wheel constant as the wheel wears due to use. The increase in speed of the grinding wheel results in an increase in speed of the dresser wheel.

It is therefore an object of this invention to maintain the rpm of a rotary dressing wheel in a constant ratio to the rpm of a rotating grinding wheel.

It is another object of the invention to maintain the rpm of a rotating dressing wheel in a constant ratio to the rpm of a rotating grinding wheel as the grinding wheel rpm is increased to maintain the surface speed thereof constant as the grinding wheel becomes worn.

DESCRIPTION OF THE PREFERRED EMBODIMENT

Figure 1:
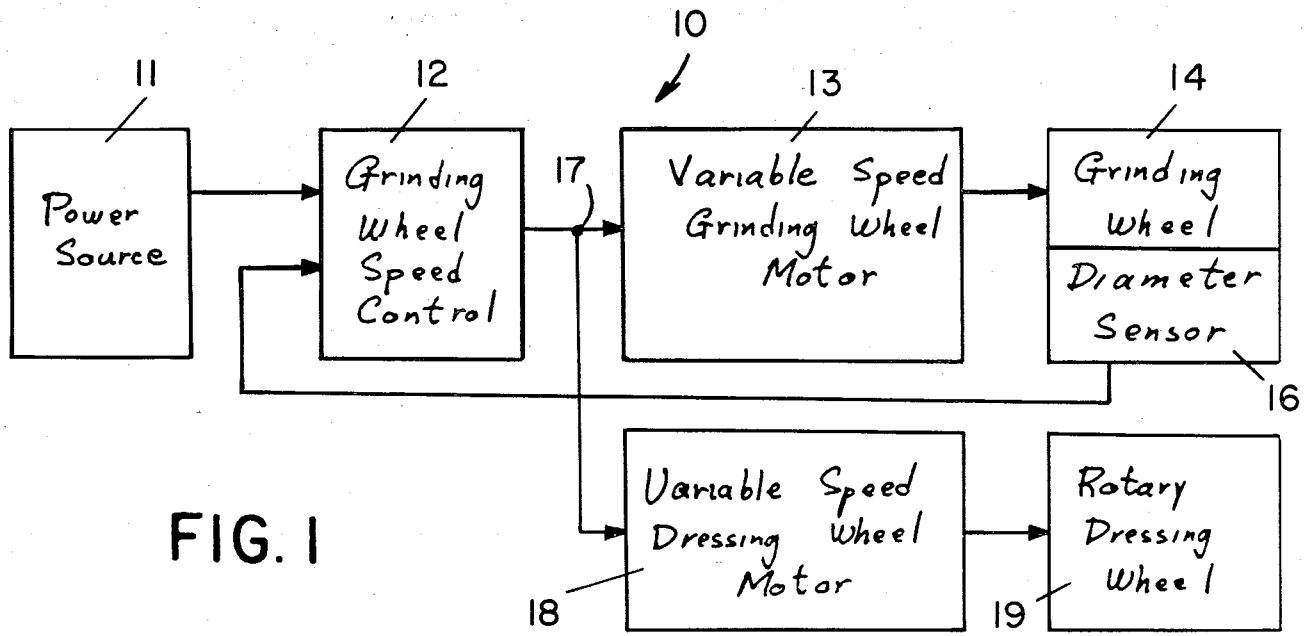
FIG. 1 shows in block diagram form a speed control for a rotary dressing wheel.

FIG. 1 shows generally at 10 a speed control drive mechanism for a rotary dresser motor. A power source

11 is coupled to a grinding wheel speed control 12. The speed control 12 couples the power from the source 11 to a variable speed grinding wheel motor 13, and this motor drives a rotary grinding wheel 14. A diameter sensor 16 is operative to develop a signal representative of the diameter of the grinding wheel 14 and to apply this signal to the grinding wheel speed control 12. In a known manner, as the diameter of the grinding wheel 14 decreases because of wear, the grinding wheel speed control 12 will increase the rpm of the grinding wheel 14 so that the surface speed of the wheel is maintained constant.

A parallel connection 17 couples the signal from the grinding wheel speed control 12 to a variable speed dressing wheel motor 18. The dressing wheel motor 18 drives a rotary dressing wheel 19. Because of the parallel connection 17, as the rpm of the grinding wheel motor is changed, so is the rpm of the dressing wheel motor changed.

This connection 17 insures that as the speed of the grinding wheel motor is increased, the speed of the dressing wheel motor will be also increased so as to maintain the speeds of the two motors 13 and 18 in a constant ratio. It has been found through actual practice that unless these two motor speeds are maintained in a constant ratio, a workpiece will not be ground in a satisfactory manner, but rather, the workpiece will develop an uneven and rough finish.

Figure 2:
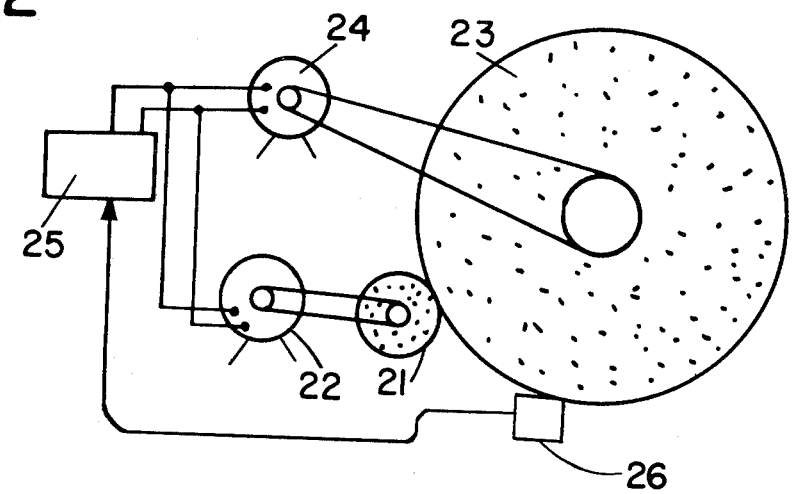
FIG. 2 shows a rotary grinding wheel and a rotary dressing wheel.

FIG. 2 shows a rotary dressing wheel 21 driven by a dressing wheel motor 22 and a rotary grinding wheel 23 driven by a grinding wheel motor 24. The dressing wheel motor 22 is connected in parallel with the grinding wheel motor 24, and both motors are under the control of a grinding wheel speed control 25 which receives a signal from the diameter sensor 26 in contact with the grinding wheel 23.

I claim:

1. In a grinding machine utilizing a rotary grinding wheel, the combination comprising:

a rotary dressing wheel, a variable speed dressing wheel motor for driving the rotary dressing wheel, first means for sensing the diameter of the grinding wheel, a variable speed grinding wheel motor for driving the rotary grinding wheel, a grinding wheel speed control, second means for increasing the speed of the grinding wheel as the grinding wheel becomes worn, and third means for increasing the speed of the dressing wheel as the speed of the grinding wheel is increased to maintain the two wheel speeds in a constant ratio.

2. The combination of claim 1 wherein the variable speed grinding wheel motor and the variable speed dressing wheel motor are connected in parallel.

* * * * *